US006260235B1

(12) United States Patent
Leung

(10) Patent No.: US 6,260,235 B1
(45) Date of Patent: Jul. 17, 2001

(54) VACUUM CLEANERS

(75) Inventor: Sing Kwok Leung, Hong Kong (HK)

(73) Assignee: Hoovine Plastic & Electronic Factory Ltd. (HK)

( * ) Notice: Subject to any disclaimer, the term of this patent is extended or adjusted under 35 U.S.C. 154(b) by 0 days.

(21) Appl. No.: 09/563,709

(22) Filed: May 2, 2000

(51) Int. Cl.[7] ..... A47C 9/00

(52) U.S. Cl. ..... 15/412; 15/422.2; 15/DIG. 1; 15/410

(58) Field of Search ..... 15/422.2, 412, 15/DIG. 1

(56) References Cited

U.S. PATENT DOCUMENTS 4,225,999 * 10/1980 Martinec et al. ..... 15/422.2
5,054,157 * 10/1991 Werner et al. ..... 15/422.2 X
5,134,752 * 8/1992 Shipman ..... 15/422.2 X
5,375,292 * 12/1994 Bailey ..... 15/422.2 X

* cited by examiner

*Primary Examiner*—Chris K. Moore
(74) *Attorney, Agent, or Firm*—Jackson Walker L.L.P.

(57) ABSTRACT

A vacuum cleaner has a central passage formed by the inside of a casing. The vacuum cleaner is conventional except that two electrically driven fans are provided. The fans are driven respectively by a DC motor 16 and an AC motor. The motors are normally switched ON and OFF individually at the option of a user.

4 Claims, 1 Drawing Sheet

VACUUM CLEANERS

BACKGROUND OF THE INVENTION

1. Field of the Invention

The invention relates to vacuum cleaners.

2. Description of Prior Art

The invention relates more particularly to domestic vacuum cleaners used in offices and in the home. In simplest form the vacuum cleaners comprise an inlet mounted inside a sweeping head and an outlet, or exhaust, connected by a passage. An electrically driven fan is mounted in the passage to draw air through the passage to create a "vacuum" inside the head so that dirt (dust and debris) is drawn into the inlet in use. A filter is mounted between the inlet and the fan to collect the dirt which is retained in a dirt collection chamber for later disposal, as required. The electric motor provided to drive the tan can be powered by an alternating current (AC) or direct current (DC) supply. Normally either an AC or a DC supply is used. AC supply is converted in the vacuum cleaner to a DC supply. It is also possible to use a combined motor that can be operated by both an AC and a DC supply. If an AC to DC convertor or a combined motor is used, the cost and/or bulk (or weight) is significantly increased. This latter problem is especially a concern for hand-holdable vacuum cleaners.

SUMMARY OF THE INVENTION

It is an object of the invention to overcome or at least reduce these problems.

According to the invention there is provided a vacuum cleaner having a passage extending from an inlet is an exhaust, a filter and a dirt collection chamber, in which electric motor driven fan means mounted in the passage is arranged to draw air into the outlet and through the passage, in which there are two motors, one alternating current motor and one direct current motor.

A separate fan may be provided for each motor.

The fans are preferably mounted in series in the passage.

The fan motor may be electrically switchable to operate simultaneously.

BRIEF DESCRIPTION OF THE DRAWINGS

A vacuum cleaner according to the invention will now be described by way of example with reference to the accompanying drawings in which.

DESCRIPTION OF THE PREFERRED EMBODIMENT

Figure 1:
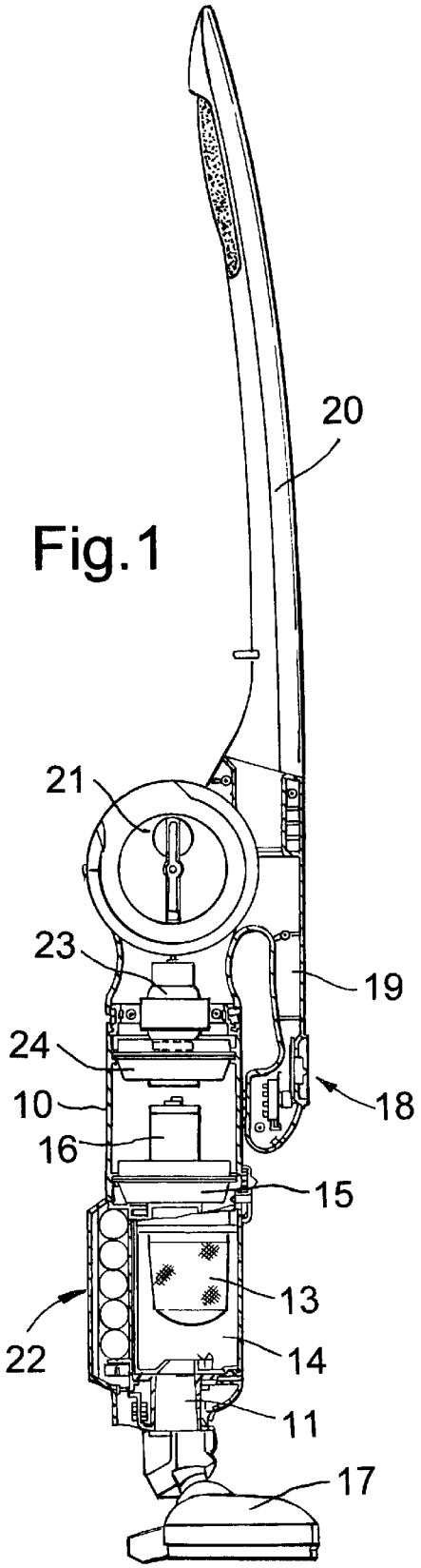
FIG. 1 is a part cross-sectional side view of the vacuum cleaner.
Figure 2:
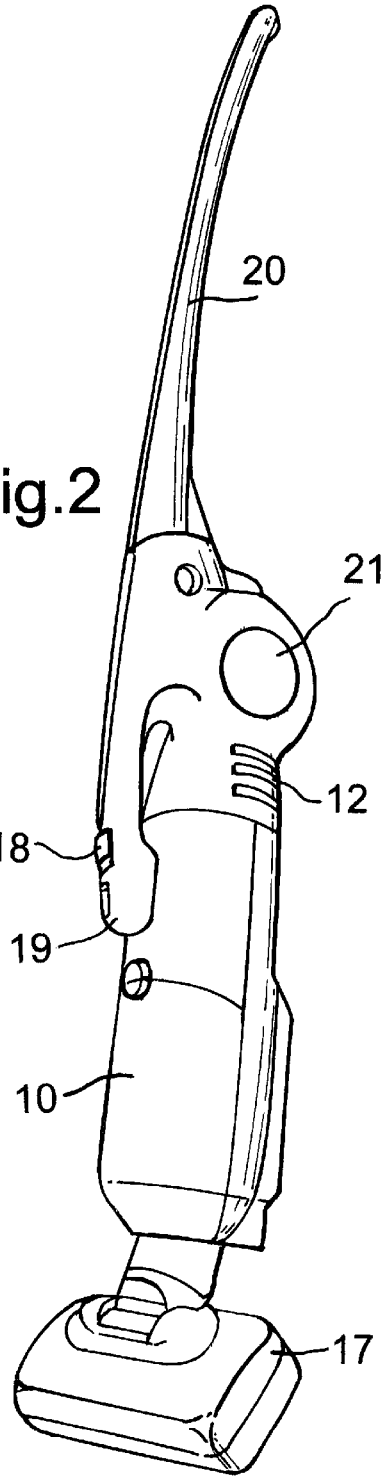
FIG. 2 is a front isometric view of the vacuum cleaner.

Referring to the drawings, a central hollow housing 10 provides a passage extending from an inlet 11 to exhaust ports 12. A filter 13 closes off the passage so that dirt drawn into the housing 10 is collected in a dirt collection chamber 14. A fan 15 driven by a centrally supported electric motor 16 creates a vacuum inside a sweeping head 17 in use. Manually operated switches 18 are mounted on an extension 19 of a handle 20. An electric supply power line is housed as a reel inside a compartment 21.

The vacuum cleaner so far described is well-known. The motor 16 may be an AC motor or a DC motor. Where it is a DC motor a re-chargeable battery pack 22 is provided; it is also possible to use an AC supply and incorporate a transformer and AC to DC convertor. The transformer and convertor may be used to recharge the battery and/or supply direct current to the motor.

In embodiments of the present invention, a second motor 23, with a second fan 24, is mounted in the housing 10. In the specific example, the motor 16 is a DC motor and the motor 23 is an AC motor. As a result, either the motor 16 or 23 may be switched ON to draw air through the same or single passage (and create the vacuum inside the head) formed by the inside of the housing 10. When the motor 16 is switched ON for example, air drawn into the housing passes through the fan 24 to the exhaust ports 12.

The described vacuum cleaner can thus be powered by an AC supply or a DC supply (which is normally the battery pack 22). This arrangement overcomes disadvantages of the prior art where such an arrangement was not possible without considerable expense or significant increase in bulk and weight of the vacuum cleaner. Embodiments of the invention are versatile in that they can be operated without an external supply so are freely portable to points-of-need. When extra capacity is required, that is increase of effective vacuum inside the head 17, it will usually be better to use the AC motor 23 to create the 25 vacuum. In any event, both motors 16 and 23 may be used (i.e. switched ON) at same time if desired. Suitable electrical switching arrangements are not shown but will be well understood by persons skilled in the art, and capable of switching the motors ON and OFF separately or at the same time.

I claim:

1. A vacuum cleaner having a passage extending from an inlet to an exhaust, a filter and a dirt collection chamber, in which electric motor driven fan means mounted in the passage is arranged to draw air into the inlet and through the passage, in which there are two motors, one alternating current motor and one direct current motor.

2. A vacuum cleaner according to claim 1, in which a separate fan is provided for each motor.

3. A vacuum cleaner according to claim 2, in which the fans are mounted in series in the passage.

4. A vacuum cleaner according to claim 3, in which the fan motors are electrically switchable to operate simultaneously.

* * * * *